US005554084A

United States Patent [19]

Jones

[11] Patent Number: 5,554,084

[45] Date of Patent: Sep. 10, 1996

[54] ABDOMINAL/HIP FLEX EXERCISE MACHINE

[75] Inventor: Gary A. Jones, Falmouth, Ky.

[73] Assignee: Hammer Strength Corporation, Cincinnati, Ohio

[21] Appl. No.: 292,466

[22] Filed: Aug. 18, 1994

[51] Int. Cl.[6] ..... A63B 23/02; A63B 21/06

[52] U.S. Cl. ..... 482/97; 482/93; 482/98; 482/134; 482/137; 482/139; 482/142

[58] Field of Search ..... 482/92–94, 97, 482/98, 104, 140, 142, 145, 133–138 95, 96, 139

[56] References Cited

U.S. PATENT DOCUMENTS

| | | | |
|---|---|---|---|
| D. 321,025 | 10/1991 | Jones . | |
| D. 321,026 | 10/1991 | Jones . | |
| D. 321,027 | 10/1991 | Jones . | |
| D. 321,028 | 10/1991 | Jones . | |
| D. 321,387 | 11/1991 | Jones . | |
| D. 321,389 | 11/1991 | Jones . | |
| D. 321,390 | 11/1991 | Jones . | |
| D. 321,391 | 11/1991 | Jones . | |
| 4,387,893 | 6/1983 | Baldwin . | |
| 4,456,245 | 6/1984 | Baldwin . | |
| 4,627,619 | 12/1986 | Rockwell et al. | 482/137 |
| 4,662,631 | 5/1987 | Seal | 482/104 |
| 4,732,380 | 3/1988 | Maag | 482/134 |
| 4,834,396 | 5/1989 | Schnell | 482/137 |
| 4,951,939 | 8/1990 | Peters | 482/94 |
| 5,044,631 | 9/1991 | Jones . | |
| 5,044,632 | 9/1991 | Jones . | |
| 5,050,873 | 9/1991 | Jones . | |
| 5,066,003 | 11/1991 | Jones . | |
| 5,066,004 | 11/1991 | Jones . | |
| 5,070,863 | 12/1991 | McArthur et al. | 482/134 |
| 5,106,080 | 4/1992 | Jones . | |
| 5,125,881 | 6/1992 | Jones . | |
| 5,135,449 | 8/1992 | Jones . | |
| 5,135,456 | 8/1992 | Jones . | |
| 5,171,198 | 12/1992 | Jones . | |
| 5,180,354 | 1/1993 | Jones . | |
| 5,181,896 | 1/1993 | Jones . | |
| 5,184,991 | 2/1993 | Brangi | 482/97 |
| 5,273,505 | 12/1993 | Jones . | |
| 5,372,556 | 12/1994 | Ropp | 482/133 |

OTHER PUBLICATIONS

Hammer Strength, Strength Jammer Summer 1990 (4 pages).

Hammer Strength, Hammer: First In Strength, (12 pages).

Leverage Machines by Nautilus, Instruction Manual (24 pages).

Keiser advertisement, Recreation, Sports & Leisure, p. 18, Feb. 1986.

*Primary Examiner*—Richard J. Apley
*Assistant Examiner*—Victor K. Hwang
*Attorney, Agent, or Firm*—Wood, Herron & Evans, P.L.L.

[57] ABSTRACT

An abdominal hip/flex exercise machine includes a frame, a seat located at a first end of the frame for supporting an exerciser in an upright exercise position facing the second end of the frame, and a lever pivotally connected to the frame between the first and second ends thereof. At the second end of the frame, the lever includes at least one hub for holding weighted plates, while the opposite end of the lever located adjacent the seat includes spaced pads and handles adapted to be engaged by the arms and hands of an exerciser supported on the seat in the upright exercise position. The exerciser acts on the pads via a downwardly directed abdominal/hip flex motion to pivot the lever about the axis against the weight resistance held at the second end thereof. A leg brace may be included to restrain the exerciser from upward movement during performance of the downwardly directed flexing exercise motion, with the leg brace and the seat being vertically adjustable to suit the height of the exerciser. This abdominal/hip flex exercise machine facilitates safe and effective performance of an abdominal/hip flex exercise motion for exercisers having a wide range of strengths and capabilities.

14 Claims, 2 Drawing Sheets

ABDOMINAL/HIP FLEX EXERCISE MACHINE

FIELD OF THE INVENTION

This invention relates to an exercise machine, and more particularly to an exercise machine for exercising the abdominal muscles in an abdominal/hip-flex exercise motion.

BACKGROUND OF THE INVENTION

Many athletes and non-athletes participate in strength conditioning programs to maintain or improve their physical condition. Typically, these programs include a prescribed number of exercise routines periodically performed by the exerciser. Each exercise routine is designed to strengthen a particular muscle group. Depending on the nature of the exercise routine, or perhaps more accurately described as the exercise motion, and the muscle group involved, either an exercise machine, free weights or another type of exercise apparatus may be used, or even no apparatus at all.

Some exercises such as a bench press or a squat lend themselves quite easily to performance using free weights, i.e., barbells and weighted plates, dumbbells, etc., or performance on exercise machines. Other exercises, particularly aerobic exercises, are adaptable to multiple modes of performance. For instance, to exercise the leg muscles and particularly the quadriceps, an exerciser may perform a stair climbing motion as the exercise routine, either by actually using a stairway in a building, a stool as a step-up device, or with a machine which simulates stair climbing. Other exercises, such as sit-ups, are often performed without any exercise apparatus, but may be aided, or even made more difficult, by the use of some exercise apparatus, i.e., an inclined board to make the sit-ups more difficult.

For the performance of some exercise routines or exercise motions, the use of an exercise machine or an exercise apparatus has not been completely satisfactory, either due to the cumbersome manner in which the exercise apparatus must be used or the high cost of the exercise machine. One such exercise motion works the abdominal muscle group and is referred to as an abdominal flex motion. In this exercise motion, the exerciser pulls the legs upwardly with the knees bent in an abdominal/hip flex motion, while supported in a substantially upright position on an exercise sometimes referred to as a "hip flex" apparatus. This hip flex apparatus includes a pair of spaced, raised forearm pads with handles on the outer ends thereof. By holding his or her body above the ground and by bracing the arms against the pads, with the elbows and shoulders held rigid, the exerciser raises the knees upwardly toward his or her torso, with the knees bent, flexing the hips slightly at the end of the motion. This exercise motion strengthens the abdominal muscle group.

While a hip flex apparatus of this type is relatively inexpensive and has proved beneficial for a large number of exercisers, its use is limited to those who can support their weight above the ground. Thus, many persons in need of abdominal muscle strengthening of the type achieved via this motion are not likely to get the needed exercise with this typical hip flex apparatus, because they simply do not have sufficient arm and shoulder strength to hold themselves in the initial braced position, or they do not have enough abdominal strength to initially lift the legs at the knees. Elderly persons, handicapped persons or those recovering from an injury are likely to fall within this category of persons unable to use this hip flex apparatus. For these people, if they do manage to get into the braced position, they may even fall or over-exert themselves.

Thus, the well known hip flex apparatus is deficient in some respects because it does not meet the abdominal exercise needs of a significant number of exercisers, and for some exercisers it represents a potential safety hazard.

There exists an exercise machine of the pulley and chain type for performing an abdominal flex motion, as shown in a brochure published by Nautilus, and this machine is called an "Abdominal Exercise Machine". The exercise motion performed within this machine is not quite the same as the abdominal flex motion described above, because the exercise motion is not really performed from an upright position, rather the exerciser must bow the body forwardly in the machine while holding handles located above the shoulders.

Additionally, while this exercise machine, like many other strength training exercise machines, provides a safety benefit because the possibility of injury due to dropped weights is reduced, this machine may aggravate back problems due to the necessity to move the torso back and forth between oppositely directed bowed positions, with the hands holding handles located above the head. This exercise machine also has a significantly higher cost than the previously described hip flex apparatus. Finally, because of its shape and configuration, this machine is difficult to get into for some exercisers of the type previously described.

Thus, this exercise machine does not fulfill the need to facilitate the performance of an abdominal flex exercise motion for a substantial number of exercisers, nor does it adequately meet the deficiencies of the present hip flex apparatus.

SUMMARY OF THE INVENTION

It is an object of this invention to facilitate the performance of an abdominal/hip flex exercise motion by exercisers who are elderly, handicapped or recuperating from an injury, or exercisers who are simply unable to support themselves in the initial braced position required by the presently available hip flex apparatus.

It is another object of this invention to maximize the effectiveness of the performance of an abdominal/hip flex exercise motion for exercisers of all ages, strengths and capabilities.

It is still another object of this invention to enhance the safety of performing an abdominal/hip flex exercise motion.

It is still another object of this invention to reduce the overall cost associated with exercising via the performance of an abdominal/hip flex exercise motion.

This invention achieves the above-stated objectives via incorporation of the abdominal/hip flex exercise motion into a lever-type exercise machine so that the benefits of the abdominal/hip flex exercise motion may be achieved from an upright and supported exercise position. More specifically, this invention relates to an exercise machine which provides a readily accessible exercise position, preferably a seat and a leg brace, for bracing the exerciser's body in engagement with one or more pads located at a raised first end of a lever. By flexing the body downwardly against the pad or pads, with the flex motion initiated from the supported position, the exerciser pivotally moves the first end downwardly while raising an opposite end of the lever which holds a selected weight resistance.

Because of the accessibility of the supported exercise position and the elimination of the need for the exerciser to support his or her weight above the ground, this abdominal/ hip exercise machine represents an improvement over the prior hip flex apparatus, which has limited accessibility for a substantial number of exercisers. Moreover, because the opposite end of the lever can be weighted lightly or heavily, as desired, the degree of difficulty for performance of the exercise can be increased or decreased over a wide range. This represents an improvement in versatility over the prior hip flex apparatus, which required at the very least that the exerciser have sufficient strength to brace himself or herself and then flex his or her legs upwardly to the stomach.

Because this invention locates the exerciser in an upright and supported position during the exercise motion, this exercise machine is safer than the prior hip flex apparatus and other abdominal exercise machines. Unlike the prior hip flex apparatus, an exerciser is not likely to fall from the supported, i.e., seated, exercise position. Moreover, the exercise position with this machine is upright and does not require bowing of the torso in opposite directions while holding handles located above the shoulders. This exercise machine also costs significantly less than the previously described pulley and chain exercise machine. Considering these factors, this invention enhances the accessibility and maximizes the effectiveness of abdominal exercise for a significant number of exercisers.

According to a preferred embodiment of the invention, an abdominal/hip flex exercise machine includes a frame which defines at a front end thereof an upright exercise position, preferably a seated position which is defined by a vertically adjustable seat and a vertically adjustable leg brace. The machine further includes a lever pivotally connected to the frame, with a first end of the lever located adjacent the seat and an opposite or second end located at an opposite or second end of the frame. The first end of the lever includes one or more engagement pads, preferably a pair of spaced forearm pads adapted to be engaged by the forearms of an exerciser supported in the exercise position and acted upon so as to be moved downwardly when the exerciser performs an abdominal/hip flex exercise motion. The second end of the lever includes at least one hub for holding a selected number of weighted plates, thereby to provide a selected weight resistance for the lever. Two spaced handles are located at the first end of the lever, one adjacent each forearm pad, thereby to facilitate continued engagement with the forearm pads during performance of the downwardly directed abdominal/hip flex motion. Bumpers at the second end of the lever coact with the frame to limit downward pivotal motion of the second end of the lever with respect to the frame, regardless of the weight.

Because of the initial orientation of the pivotally connected lever, a very low weight resistance may be applied to the second end. This is particularly important for exercisers recuperating from an injury, when it is necessary to initially exercise against very low weight resistance. This feature also benefits other exercisers who for one reason or another must exercise against a very low resistance.

If desired, the second end of the frame and lever may be adapted to hold weighted plates or a fixed weight stack utilizing a pin to select the desired weight resistance, as is known in this field.

At the first end of the lever, as described, two spaced forearm pads will most commonly be used by the exerciser to engage the lever during the performance of the downwardly, directed abdominal/hip flex exercise motion. However, one such pad, or even a centrally located single pad, may also prove suitable, perhaps for single arm or double arm amputees. For these exercisers, one arm or even the forehead could be placed in engagement with the pad to act thereagainst to perform the exercise motion.

Because of the adjustability of the seat and the leg brace, this exercise machine fits exercisers of all sizes equally well.

Because the second weighted end of the lever produces an upwardly directed force at the first end of the lever, the back and spinal column of the exerciser are never compressed when using the machine. In fact, by setting the seat at a relatively low level with respect to the pads, thereby requiring the exerciser to sufficiently "raise up" on his or her haunches to reach the pads, the subsequent downward easing of the exerciser's torso will then pivot the lever slightly to raise the weighted second end. This creates an upwardly directed force at the first end of the lever and produces a traction type effect on the spinal column of the exerciser.

The total distance moved during performance of an abdominal/hip flex motion with this exercise machine is relatively low, i.e., less than 12 inches, as compared to other lever-type exercise machines of which applicant is aware. However, the benefits to the abdominal muscle group via performance of an abdominal/hip flex motion are maximized because of the optimal isolation of this muscle group when in this upright and supported exercise position. Moreover, applicant is not aware of any other lever-type exercise machine which adequately works this abdominal muscle group. In short, for this exercise motion, the isolation of the muscle group with respect to the rest of the body plays a more important role in determining the effectiveness of the exercise motion, compared to the distance traversed during the exercise motion.

Compared to the abdominal exercise machine described in the background section, the abdominal/hip flex exercise machine of this invention costs significantly less, is more readily accessible by a greater number of exercisers and provides a much welcome traction effect which eliminates compression on the spinal column.

These and other features of the invention will be more readily understood in view of the following detailed description and the drawings.

DETAILED DESCRIPTION OF THE DRAWINGS

Figure 1:
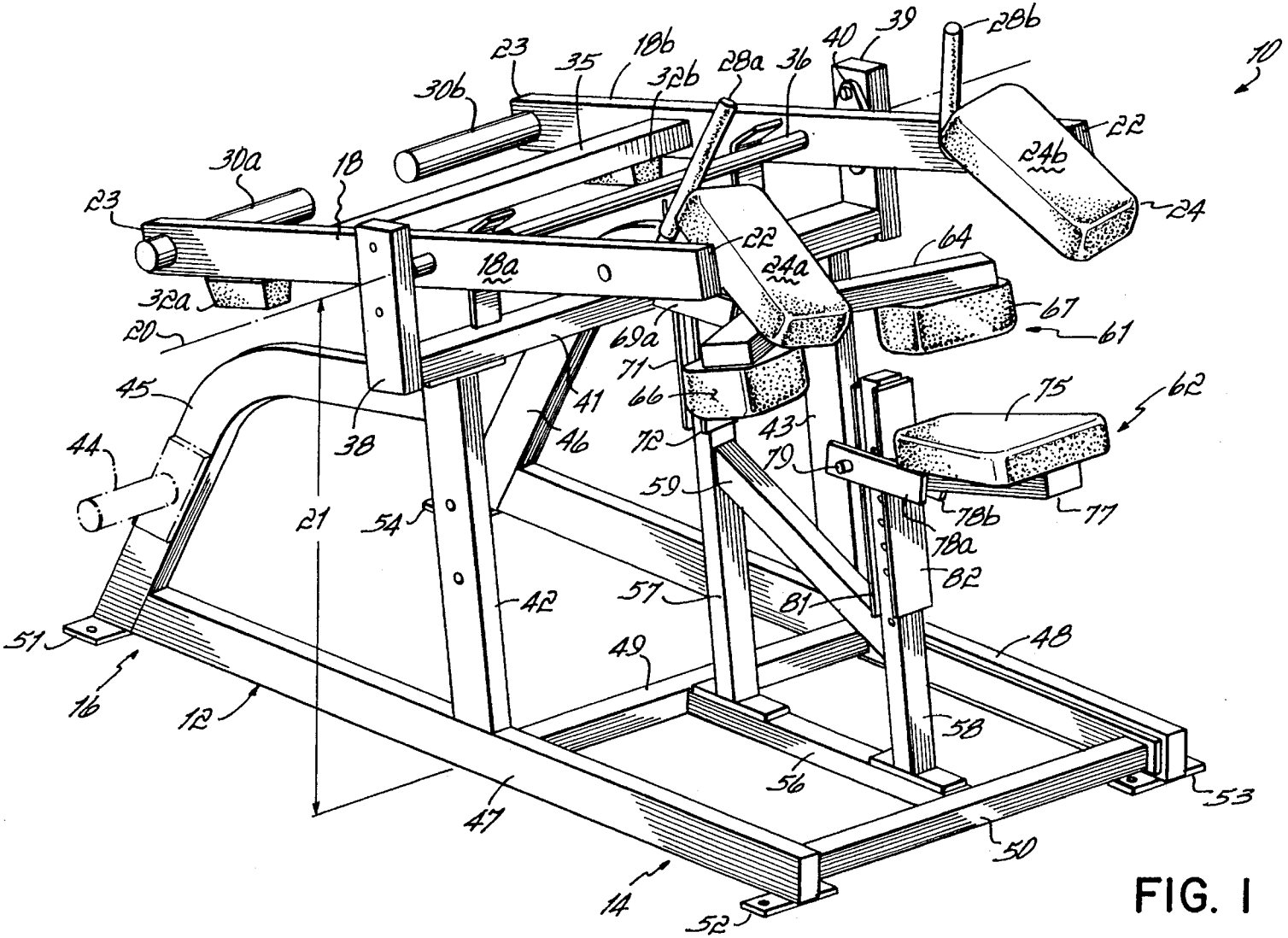
FIG. 1 is a perspective view of an abdominal/hip flex exercise machine constructed in accordance with a preferred embodiment of the invention.
Figure 2:
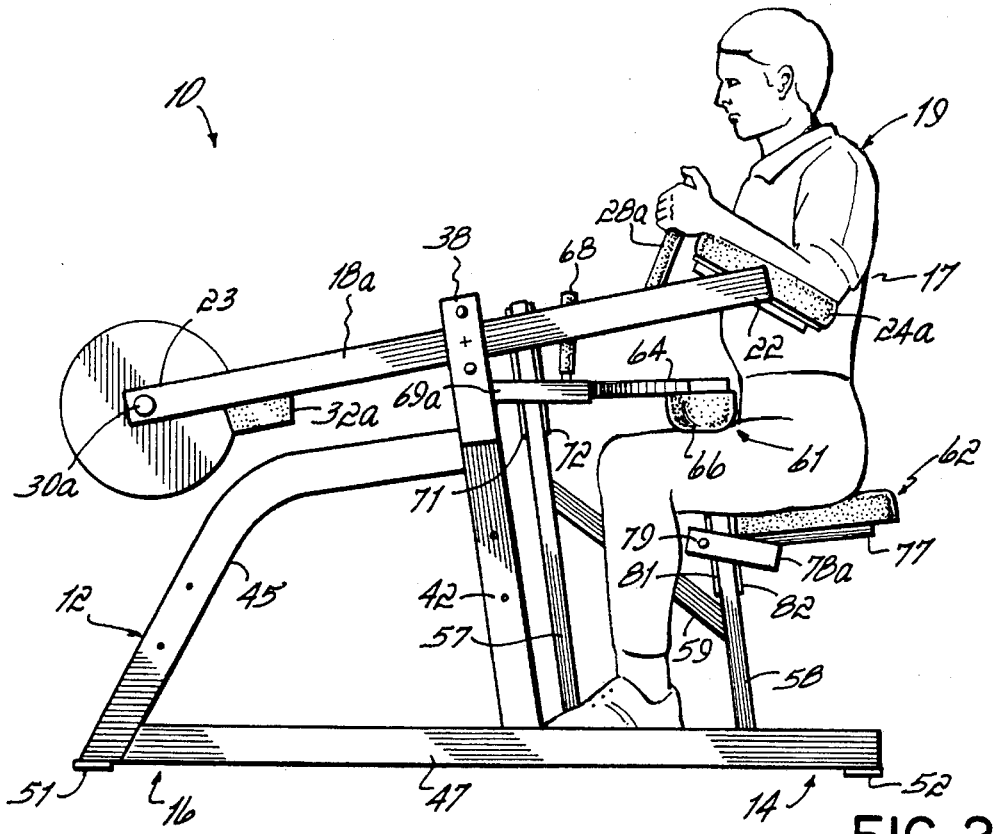
FIG. 2 is a side view of the abdominal/hip flex exercise machine shown in FIG. 1, but also showing an exerciser in an exercise position and ready to perform an abdominal/hip flex exercise with the machine.
Figure 3:
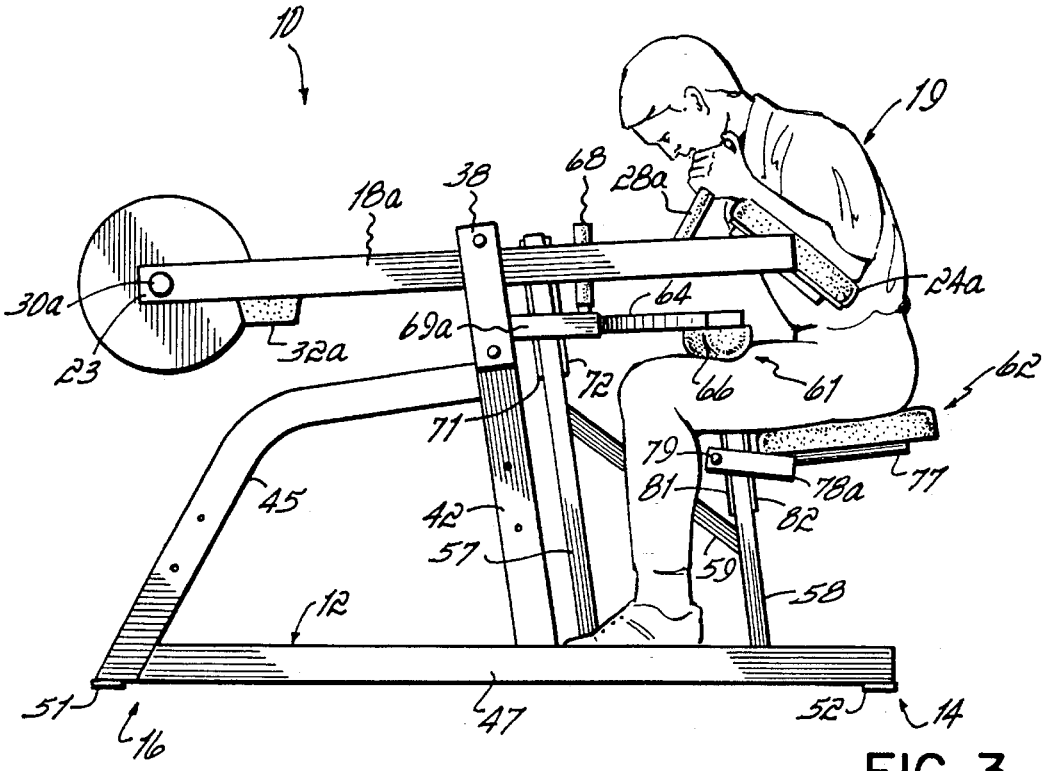
FIG. 3 is a side view, similar to FIG. 2, which shows the exerciser and the abdominal/hip flex exercise machine of this invention after the exerciser has pivotally moved the weighted lever via completion of a downwardly directed abdominal/hip flex motion.

FIGS. 1–3 shown an abdominal/hip flex exercise machine 10 constructed in accordance with a preferred embodiment of the invention. The machine 10 includes a frame 12 made of a number of straight and/or curved sections of heavy duty steel which are either welded or bolted together, or pivotally connected, as understood in the art. The frame 12 has a first end 14 and a second end 16, and the frame 12 generally defines at the first end 14 a supported and upright exercise position 17 for an exerciser 19 (shown in FIGS. 2 and 3) facing the second end 16 of the frame 12.

A lever 18 is hingedly connected to the frame 12 along a horizontal pivot axis 20, which is located a predetermined vertical distance 21 above the floor upon which the frame 12 rests. The lever 18 includes a first end 22 and a second end 23 which correspond to the first end 14 and the second end 16 of the frame 12, respectively. The first end 22 rigidly supports at least one engagement pad 24 adapted to be engaged and acted upon by the exerciser 19 when in the exercise position 17. Preferably, two engagement pads 24 are provided in the form of a pair of spaced forearm pads **24*a* and 24*b* each connected, at a downwardly extending angle, to the first ends of corresponding spaced lever sections 18*a* and 18*b*, respectively. The first end 22 of the lever 18 also rigidly supports a pair of spaced handles 28*a* and 28*b*, with each handle 28*a* or 28*b* located adjacent a respective forearm pad 24*a* or 24*b***.

The second end 23 of the lever 18 is adapted to hold a selected weight resistance to resist pivotal movement about the axis 20 upon application of a downwardly directed force at the first end 22 of the lever 18. Preferably, the second end 23 of the spaced lever sections **18*a* and 18*b* rigidly support a pair of spaced hubs 30*a* and 30*b*, respectively, with each hub 30*a* or 30*b* adapted to hold a selected number of weighted plates (FIGS. 2 & 3**).

Alternatively, the second end 23 of the lever 18 may be connected to a pulley and cable or chain arrangement for lifting a selectorized weight stack, if desired.

At the second end 23, the lever sections **18*a* and 18*b* also preferably include bumpers 32*a* and 32*b*, respectively, located on bottom ends thereof and adapted to coact with the frame 12 to limit downward pivotal movement about the axis 20 due to the weight held at the second end 23**.

The lever 18 also includes a center brace 35 and an axle 36 which extends along the pivot axis 20. Opposite ends of the axle 36 connect to uprights 38 and 39 via a pair of bearings 40 one of which is partially shown in FIG. 1. A pillow block bearing 40 sold by Browning, Part No. VF2S, has proved suitable. These bearings require maintenance only once a year, maintenance which consists of one shot of lubricating oil.

The bottom ends of the uprights 38 and 39 connect to an upper central crossbeam 41. The crossbeam 41 is supported by central legs 42 and 43 which in turn connect to curved front legs 45 and 46, respectively. Preferably, the legs 45 and 46 each have a weight horn 44 rigidly connected thereto, for supporting, at a close location, weighted plates when not in use. The central legs 42 and 43 and the front legs 45 and 46 rigidly connect to outer support members 47 and 48, respectively, at the bottom of the machine 10. These outer support members 47 and 48 are also connected via a lower central brace 49 and a rear brace 50. Preferably, the frame 12 is supported at its outer corners by welded bottom plates 51, 52, 53 and 54. Preferably, these bottom plates 51–54 have bolt holes for optional securement of the machine 10 to a portable base.

The lower central brace 49 and the rear brace 50 are connected via a center beam 56. A forward support 57 and a rearward support 58 extend upwardly therefrom, with an angled brace 59 extending therebetween. The forward support 57 leans slightly forwardly and supports a leg brace at an upper end thereof, designated generally by reference numeral 61, and the rearward support 58 supports a seat adjacent an upper end thereof designated generally by reference numeral 62.

More specifically, the leg brace 61 includes a Y-shaped member 64 with pads 66 and 67 secured to the bottom thereof at the branch ends of the Y-shape. A handle 68 connects to the top of the member 64 to assist vertical movement thereof. The Y-shaped member 64 is rigidly connected to a pair of spaced substantially vertical plates 69 located on opposite sides of support 57. These spaced plates 69 are rigidly welded together via spaced horizontal bars, (not shown), which bear against and frictionally engage a pair of sandwiching members 71 and 72 located on first and second sides of the support 57, respectively. This structure renders the leg brace 61 vertically adjustable along the support 57 in the same manner as the seat is made adjustable in other prior patents owned by assignee and issued in the name of this inventor. That is, by grasping the handle 68 and tilting the pads 66 and 67 upwardly to disengage the spaced bars from the sandwiching members 71 and 72, the leg brace 61 can be moved along support 57 to a desired level.

Similarly, the seat 62 comprises a cushion 75 supported on the top of a brace 77, which is in turn connected via opposing arms **78*a* and 78*b* to the support 58. The opposing arms 78*a* and 78*b* are interconnected via spaced horizontal bars 79 (only one shown) which act upon oppositely directed surfaces of two sandwiching members 81 and 82 secured to support 58. This allows the seat 62 to be vertically adjusted by tilting the rearward end thereof upwardly to move the spaced bars away from frictional engagement with the members 81 and 82, and then moving the seat 62 along support 58** to the desired height.

In use, as shown in FIGS. 2 and 3, the exerciser 19 places a selected number of weighted plates on the hubs **30*a* and/or 30*b* to achieve a desired weight resistance. The exerciser 19 then sets the desired vertical positions of the seat 62 and the leg brace 61 and puts his or her body in the exercise position 17 defined by these portions of the frame 12. That is, the exerciser is seated in the seat in the desired upright exercise position with the tops of his or her legs or thighs located below and pressing up against the pads 66, 67 of the leg brace 61. With the forearms engaging the pads 24*a* and 24*b*, and the hands of the exerciser 19 grasping the handles 28*a* and 28*b* located at the forward ends of the pads 24*a* and 24*b*, the exerciser 19 flexes his or her torso in a downwardly and forwardly directed motion, with the arms and hands held rigidly against the appropriate parts of the lever 18, thereby to pivot the lever 18 about the axis 20 and against the selected weight resistance held at the opposite end thereof. Stated another way, the weight resistance at the second end 23 of the lever 18 resists the downward motion applied at the first end 22 thereof by the exerciser 19 located in the upright exercise position 17**.

Compared to other lever-type exercise machines, pivotal movement of this exercise machine 10 is relatively small, and probably no more than 10–12 inches, at most. However, because of the structural arrangement of the lever 18 and the manner in which the selected weight resistance is applied to this muscle group, the abdominal muscles of the exerciser are effectively isolated throughout this entire abdominal hip flex motion. As a result, through this relatively short distance, this machine 10 optimizes the benefits obtainable via the performance of an abdominal/hip flex exercise motion.

Additionally, because of the relative position of the seat 62 with respect to the pads **24*a* and 24*b*, and the leg brace 61, the spinal column of the exerciser 19 is never compressed during the exercise motion. Moreover, if the seat 62 is set at a relatively low vertical level so that the exerciser 19 must extend his or her torso upwardly to place the forearms in engagement with the pads 24*a* and 24*b*, followed by a downward easing of the torso, the second end 23 of the lever 18 will raise up slightly, thereby producing an upwardly directed force at the first end 22 of the lever 18. This effectively produces a traction effect on the spinal column of the exerciser 19. Because this procedure also initially raises the second end 23 of the lever 18, the abdominal/hip flex exercise motion does not have to be initiated with the lever 18 in a dead stop position, with the bumpers 32***a* and 32*b* resting on the frame 12.

Thus, by optimally isolating the abdominal muscles because of the structure of the machine 10, this abdominal hip/flex exercise machine 10 maximizes the benefits obtainable via the performance of an abdominal hip/flex exercise motion. Yet, the risk of injury to the exerciser 19 is negligible because the exercise is performed from a seated upright position. Finally, compared to other abdominal exercise machines, these benefits are achieved in a cost effective manner.

If desired, the lever 18 may be lengthened, shortened, or curved in a desired direction to achieve a desired strength curve for the downward flexing motion. Preferably, the hubs 30*a* and 30*b* located at the second end 23 of the lever 18 and the forearm pads 24*a* and 24*b* and the handles 28*a* and 28*b* located at the first end 22 of the lever 18 effectively counterbalance each other, so that without any weight resistance applied at the second end 23 the total resistance is effectively zero. This enables the machine 10 to be used with very low weight resistance, thereby rendering the machine 10 suitable for use by exercisers who are elderly, handicapped, or those rehabilitating an injury, when it is necessary to exercise against an extremely low weight resistance.

Additionally, or alternatively, a single center pad 24 may be engaged to affect pivoting of the first end 22 of the lever 18 in the downward direction. This center pad 24 variation would most directly benefit single or double arm amputees, or exercisers who for one reason or another must initiate the downward flexing motion via engagement and movement of the head, rather than both forearms.

While a preferred embodiment of the invention has been shown and described, it is to be understood that the invention is not limited thereby and that in light of the present disclosure, various other alternative embodiments will be apparent to a person skilled in the art. More specifically, while the particular angles and dimensions of the lever and its attendant structural components are considered to be optimum at this point in time, it is entirely possible that some further refinements may evolve. Accordingly, it is to be understood that changes may be made without departing from the scope of the invention as particularly set forth and claimed.

I claim:

1. An abdominal/hip flex exercise machine comprising:

a frame supported on a floor, the frame having a first end adapted to support an exerciser in an upright exercise position facing a second end of the frame;

a lever pivotally connected to the frame intermediate the first and second ends of the frame and pivotable about a horizontal axis located above the floor, the lever having first and second ends corresponding to the first and second ends of the frame, the horizontal axis spaced away from the upright exercise position;

a weight bolder located proximate the second end of the lever and adapted to provide a weight resistance to movement of the lever about the axis; and a pair of forearm pads mounted in a spaced relation proximate the first end of the lever adjacent the upright exercise position and angled downwardly from a horizontal toward the upright exercise position, the pads adapted to be engaged by forearms of the exerciser when in the upright exercise position, and the pads being acted upon by the exerciser in a downwardly directed abdominal/hip flex motion initiated from the upright exercise position, thereby to pivot the lever about the axis against the weight resistance at the second end thereof and to exercise an abdominal muscle group of the exerciser.

2. The abdominal/hip flex exercise machine of claim 1 further comprising:

a seat connected to and extending upward from the frame to a position below the pads.

3. The abdominal/hip flex exercise machine of claim 2 further comprising members connected between the seat and the frame for vertically adjusting the seat.

4. The abdominal/hip flex exercise machine of claim 1 wherein the weight holder comprises a hub adapted to hold a selectable number of weighted plates.

5. The abdominal/hip flex exercise machine of claim 1 and further comprising:

a stop for limiting downward movement of the second end of the lever with respect to the frame.

6. The abdominal/hip flex exercise machine of claim 1 further comprising:

a pair of handles, the handles mounted proximate the first end of the lever in spaced relation, with each handle located adjacent a forearm pad and adapted to be grasped by one of the hands of the exerciser when the exerciser is in the upright exercise position, with one of the respective forearms of the exerciser supported on a respective pad.

7. The abdominal/hip flex exercise machine of claim 1 further comprising:

a leg brace located adjacent the first end of the frame and adapted to bear against the tops of the legs of an exerciser when the exerciser is in the upright exercise position, thereby to restrain the exerciser from upward movement therefrom during performance of the downwardly directed abdominal/hip flex motion.

8. The abdominal/hip flex exercise machine of claim 7 further comprising:

members connected between the leg brace and the frame for vertically adjusting the leg brace.

9. An abdominal exercise machine comprising:

a frame supported on a floor, the frame having first and second ends;

a seat located proximate the first end of the frame and adapted to support an exerciser in an upright exercise position facing the second end of the frame;

a lever pivotally connected to the frame above the floor, the lever having a first end located adjacent the seat and a second end located opposite thereof and having a weight resistance, the lever being pivotal about a horizontal axis located between the second end of the frame and the seat; and at least one exerciser engagement pad mounted proximate the first end of the lever at a location adjacent the upright exercise position and angled downwardly from a horizontal toward the upright exercise position, the pad adapted to be engaged and acted upon by forearms of the exerciser in a downwardly directed flexing motion initiated from the upright exercise position, thereby to pivotally move the lever about the axis against the weight resistance and to exercise an abdominal muscle group of the exerciser.

10. The abdominal/hip flex exercise machine of claim 9 wherein the the pad further comprises:

a pair of forearm pads mounted proximate the first end of the lever in spaced relation, each of the pads adapted to be engaged by a forearm of the exerciser.

11. The abdominal/hip flex exercise machine of claim 9 further comprising:

a weight holder for receiving weights to vary the weight resistance of the second end of the lever.

12. The abdominal/hip flex exercise machine of claim 9 and further comprising:

a leg brace located between the seat and the axis and adapted to engage the tops of the legs of an exerciser supported on the seat in the upright exercise position.

13. The abdominal exercise machine of claim 12 wherein the leg brace and the seat are vertically adjustable, thereby to enable an exerciser to adjust the seat and the leg brace to desirable vertical positions with respect to the at least one exerciser engagement pad.

14. An abdominal/hip flex exercise machine comprising:

a frame supported on a floor, the frame having a first end adapted to support an exerciser in an upright exercise position facing a second end;

a lever connected to the frame above the floor, the lever pivoting about a horizontal axis located between the second end of the frame and the upright exercise position, the lever having first and second ends corresponding to the first and second ends of the frame;

a weight holder located proximate the second end of the lever and adapted to provide a weight resistance to movement of the lever about the axis; and a forearm pad mounted proximate the first end of the lever and angled downwardly from a horizontal toward the upright exercise position, the pad adapted to be engaged and acted upon by a forearm of the exerciser in a downwardly directed abdominal/hip flex motion initiated from the upright exercise position to pivot the lever about the axis against the weight resistance and to exercise an abdominal muscle group of the exerciser.

* * * * *